United States Patent [19]

Steidinger

[11] 4,208,066

[45] Jun. 17, 1980

[54] METHOD FOR PRODUCING A FORM SUITABLE FOR AIRLINE TICKETING

[75] Inventor: Donald J. Steidinger, Barrington, Ill.

[73] Assignee: Wallace Business Forms, Inc., Hillside, Ill.

[21] Appl. No.: 914,381

[22] Filed: Jun. 12, 1978

Related U.S. Application Data

[63] Continuation-in-part of Ser. No. 483,952, Jun. 28, 1974, Pat. No. 4,109,936, and a continuation-in-part of Ser. No. 453,556, Mar. 21, 1974, abandoned, and a continuation-in-part of Ser. No. 374,274, Jun. 27, 1973, abandoned.

[51] Int. Cl.[2] ..... B42F 3/00; B42C 3/00

[52] U.S. Cl. ..... 282/11.5 A; 282/21 R; 282/24 R

[58] Field of Search ..... 282/11, 12, 20 R, 21 R, 282/22, 24 R; 270/52, 53

[56] References Cited

U.S. PATENT DOCUMENTS

| | | | |
|---|---|---|---|
| 2,108,462 | 2/1938 | Wiswall | 282/11.5 R |
| 2,118,655 | 5/1938 | Phillips et al. | 282/11.5 A |
| 3,877,728 | 4/1975 | Herz | 282/11.5 A |

*Primary Examiner*—John McQuade

*Attorney, Agent, or Firm*—Tilton, Fallon, Lungmus & Chestnut

[57] ABSTRACT

A method of producing a form suitable for airline ticketing wherein interior plies are transversely cut while the exterior plies are only weakened, the cutting of the interior plies occurring before the second exterior ply is united to the remainder of the form.

12 Claims, 5 Drawing Figures

METHOD FOR PRODUCING A FORM SUITABLE FOR AIRLINE TICKETING

This application is a continuation-in-part of my co-pending application Ser. No. 483,952, filed June 28, 1974, now U.S. Pat. No. 4,109,936, that application in turn was a continuation-in-part of co-pending application Ser. No. 453,556, filed Mar. 21, 1974, now abandoned; that case being a continuation in part of co-pending application Ser. No. 374,274, filed June 27, 1973, now abandoned.

BACKGROUND AND SUMMARY OF INVENTION

This invention relates to a method of producing a form suitable for airline ticketing and, more particularly, to a so-called "automated" ticket, i.e., one suitable for computer printing.

In the early 1970's, the airlines were considering computer printing of tickets. Almost every air traveler has, on occasion, had to wait while a ticket clerk laboriously filled in various numbers, names, etc. The project for developing an automated ticket was handled by the International Air Transport Association. The form of ticket specified for automation was that of Herz Pat. No. 3,877,728.

The Herz construction adopted by the IATA had generally the appearance of a business form—having control margins equipped with line holes for stepping the form through a computer printer. The continuous form was separable into individual ticket booklets by slitters in the computer printer which were used to remove the control margins at the same time the ticket was being printed—where upon the individual panels or tickets would automatically separate one from another because the slitting along the control margins would intersect transverse slits.

Although a number of problems characterize the Herz ticket, perhaps the most vexing problem involved buckling and wrinkling on the one hand or "tenting" on the other.

Buckling and wrinkling occur when the adhesive that fastens the continuous webs dries before the webs are folded. When this is the case, the outermost web of the fold has the longest path so those with shorter paths have no place to go (upon zig-zag folding) except to buckle. Then when a series of folds are introduced, the weight of the pack converts these buckles into wrinkles. Then, even on unfolding, the wrinkles are still there.

On the other hand, tenting occurs when the adhesive that fastens the continuous webs dries after the webs are folded. However, upon unfolding, and when the glue is dried, the innermost web of the fold defines the form length and the outer webs having been shingled relative thereto, assume a "tent" configuration. These irregularities or distortions can, on occasion, jam the computer, interfere with optical scanning or otherwise interfere with what was hoped to be a mechanized operation.

According to the invention, as articulated in my prior application Ser. No. 483,952, filed June 28, 1974, now U.S. Pat. No. 4,109,936, at least one exterior ply has control margins which are continuous while the interior plies are narrower, i.e., lacking control margins, and are transversely severed to define discrete ticket booklets—as are the exterior ply or plies between control margins. This approach has been successful in avoiding the problems inherent in the use of the Herz ticket. However, with the advent of other computers, difficulties have arisen and which are solved by the instant invention.

When it is advantageous for the computer system to use a form where only one of the exterior plies can be wider or if neither exterior ply can be wider it is no longer possible to cut the interior plies into packets of cut sheets as is necessary to avoid the buckling and wrinkling or tenting problems characteristic of Herz. The free edges cause computer feeding problems.

Further, it is not possible to make the packets of cut sheets equal in length to the exterior plies and assemble them later to the carrier ply as this leaves no margin for small errors in length or positioning of the packets. Small errors will tend to accumulate and prevent successful folding of the tickets into a pack.

Others have tried to solve this need by attaching ticket packets made in one operation to a continuous carrier ply in a later operation. First attempts using tickets with one stub and loose ends gave computer feeding troubles due to the loose flapping ends.

Another attempt by others is to provide the ticket packet with a stub at each end and to fasten the packet to the continuous carrier in a later operation at both ends. This solves the feeding problem but requires that the ticket agent remove one stub with up to 10 plies of paper from each ticket before it is presented to the customer. The second stub is also wasted paper, about 6% to the total form.

This invention shows how the packet of cut tickets can be cut to the exact length of the exterior carrier ply and positioned in register without accumulating errors so as to enable reliable refolding into a pack and avoid the buckling and wrinkling or tenting problems of continuous glued forms.

The invention further shows how the cut sheet packets can be economically fabricated from continuous webs and be made shorter than the exterior carrier plies and also avoiding the buckling and wrinkling or tenting problems and maintain register of the cut packet with the exterior plies for accurate computer printing and reliable optical scanning of the redeemed tickets.

In either case the exterior plies are continuous and control the cut edges of the tickets so they do not cause computer feeding or refolding problems. They are weakened for convenient eventual separation of the printed ticket from the continuous series.

According to the instant invention, a plurality of webs are advanced toward a uniting station for union with another web which ultimately becomes one of the exterior plies of the form. Thus, the plurality of webs ultimately constitute the interior plies. Then, prior to the union with still another web which ultimately becomes the other exterior ply, the plurality of webs are transversely cut and the first mentioned single web is transversely weakened. Resulting therefrom is a uniquely contained packet lacking free edges or the buckling and wrinkling or tenting problems which could interfere with the smooth and trouble-free desired mechanized operation. Other objects and advantages of the invention may be seen in the details of construction and operation set down in the ensuing specification.

DETAILED DESCRIPTION

The invention is described in conjunction with the accompanying drawing, in which.

Figure 1:
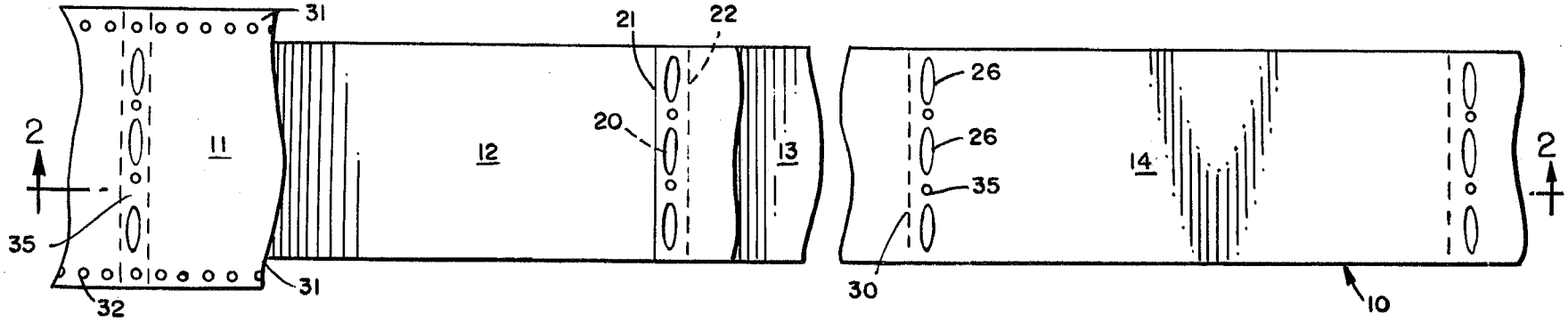
FIG. 1 is a fragmentary top plan view of a business form suitable for airline ticketing and which incorporates teachings of the invention.

Referring first to FIG. 1, a business form which is an airline ticket which is designated 10 and includes a top ply or layer 11, a plurality of intermediate plies (two of which are illustrated at 12 and 13), and a bottom ply or layer 14.

Figure 4:
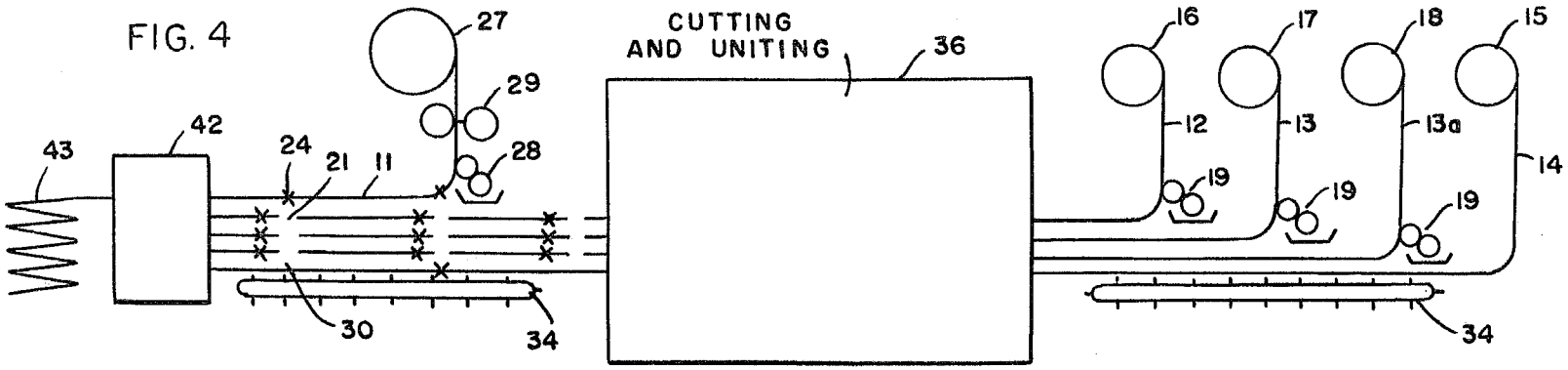
FIG. 4 is a side elevational view (generally schematic) of apparatus employed in the practice of the inventive method.

The method of manufacture can be appreciated from a consideration of FIG. 4. In that view and at the extreme upper right, a parent roll 15 is seen to provide a web 14 which, when incorporated into a business form such as an airline ticket, becomes the bottom ply 14 of FIG. 1. Also seen in the upper right hand portion of FIG. 4 are three other parent rolls 16, 17 and 18 which provide, respectively, webs 12, 13 and 13*a*, viz., the webs that ultimately become the interior plies of the form of FIGS. 1 and 2. It will be immediately appreciated that the number of intermediate plies can be varied substantially—depending upon the intended use of form. Many airline tickets have eight interior plies so as to provide an auditor's coupon, a number of flight coupons, credit card charge form, passenger's receipt, etc.

As seen in FIG. 4, the webs 12, 13, 13*a* ultimately constituting the interior plies are equipped with adhesive through adhesive units 19. More particularly, the adhesive is laid down in longitudinally spaced areas as at 20 in FIGS. 1 and 2. More particularly, the area of adhesive lay-down is the so-called stub portion of the ticket which can be seen to be defined between a line of severance 21 (see the central portion of FIG. 1) and a line of perforation 22. The stub area can also be appreciated from a consideration of the portion designated 23 at the extreme left hand portion of FIG. 2. There, it will be seen that the top ply 11 is equipped with a pair of lines of weakness or perforation as at 24 and 25. The stub portion lies between these two lines of weakness and the top ply 11 is adhered to the uppermost interior ply 12 by adhesive as at 26.

This can be appreciated from a consideration of the left hand portion of FIG. 4 wherein a parent roll 27 provides the web 11. Adhesive 26 is applied to the web 11 at longitudinally spaced areas by means of the adhesive applying roll unit 28. Additionally, the lines of weakness as at 24 may be introduced into the web 11 by means of a perforating unit 29—or, as is the case with the lines of weakness 30 in the bottom ply 14, these may be introduced into the web roll during the time of printing, i.e., at another place and time from that depicted schematically in FIG. 4.

Figure 2:
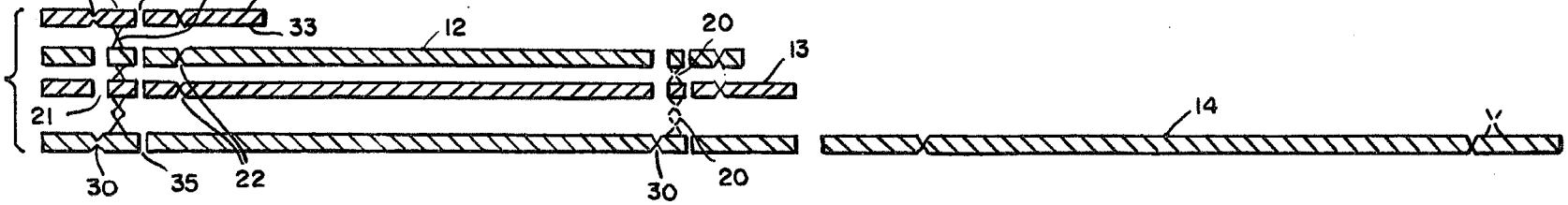
FIG. 2 is a sectional view (enlarged and exploded) taken along the line 2—2 of FIG. 1.

In the use of the form depicted in FIGS. 1 and 2, the upper ply 11 is seen to be wider than the remaining plies to provide feeding margins as at 31. The margins 31 may be equipped with line holes 32 as shown or may be imperforate for engagement with feed wheels (rather than pin belts) and which are responsive to optically sensed registration marks (not shown). Alternatively, the feeding wheels may be positioned closer together and the feed margins 31 omitted. In any event, the continuous business form is fed through a computer printer where relevant information is applied. Normally, the under side 33 of the top ply 11 is equipped with carbon so that the letter impact is transferred through the top ply 11 to the uppermost intermediate ply 12. In like fashion, the intermediate plies 12 are equipped with carbon on their underside so as to transfer the imprint to the next layer therebelow.

After the continuous form has been printed, the form is separated into discrete tickets or packets—as by bursting along the lines of weakness 24 and 30 (in the top and bottom plies 11 and 14, respectively) as seen in the extreme left hand portion of FIG. 2. Then the person handling the ticket tears off the top ply 11 and discards the same. Thus, if the feed margins 31 are utilized, they are effectively removed from the ticket before the ticket is given to the passenger. Remaining is a packet made up of plies all having the same width and which extend between the transverse cuts 21 in the intermediate plies 12, 13, etc., alternatively, the lines of weakness 30 in the bottom ply 14.

From the foregoing, it will be appreciated that as the business form 10 proceeds through the computer, both the top and bottom layers are continuous and only equipped with lines of weakness, not transverse slits. Thus, any possibility of the ticket to hang-up or otherwise get caught while proceeding through the computer printer is avoided—all while having only the two exterior plies continuous and all the interior plies completely severed into individual packets of cut sheets so that the problems of tenting or buckling are avoided.

In the practice of the inventive method, the various parent rolls are unwound with the webs issuing therefrom being controlled by pin belts (illustrated schematically as at 34 in the upper central portion of FIG. 4). The pin belts engage the register opening 35 provided in each of the webs 11–14.

Initially, the webs 12, 13, 13*a*, etc., are advanced toward a uniting station which is schematically represented in the central portion of FIG. 4 and designated by the numeral 36. Essentially, the station 36 provides a cutting and uniting function. There the webs 12, 13, 13*a* are united to each other and may be advantageously cut incident to being united with the bottom web 14.

Figure 5:
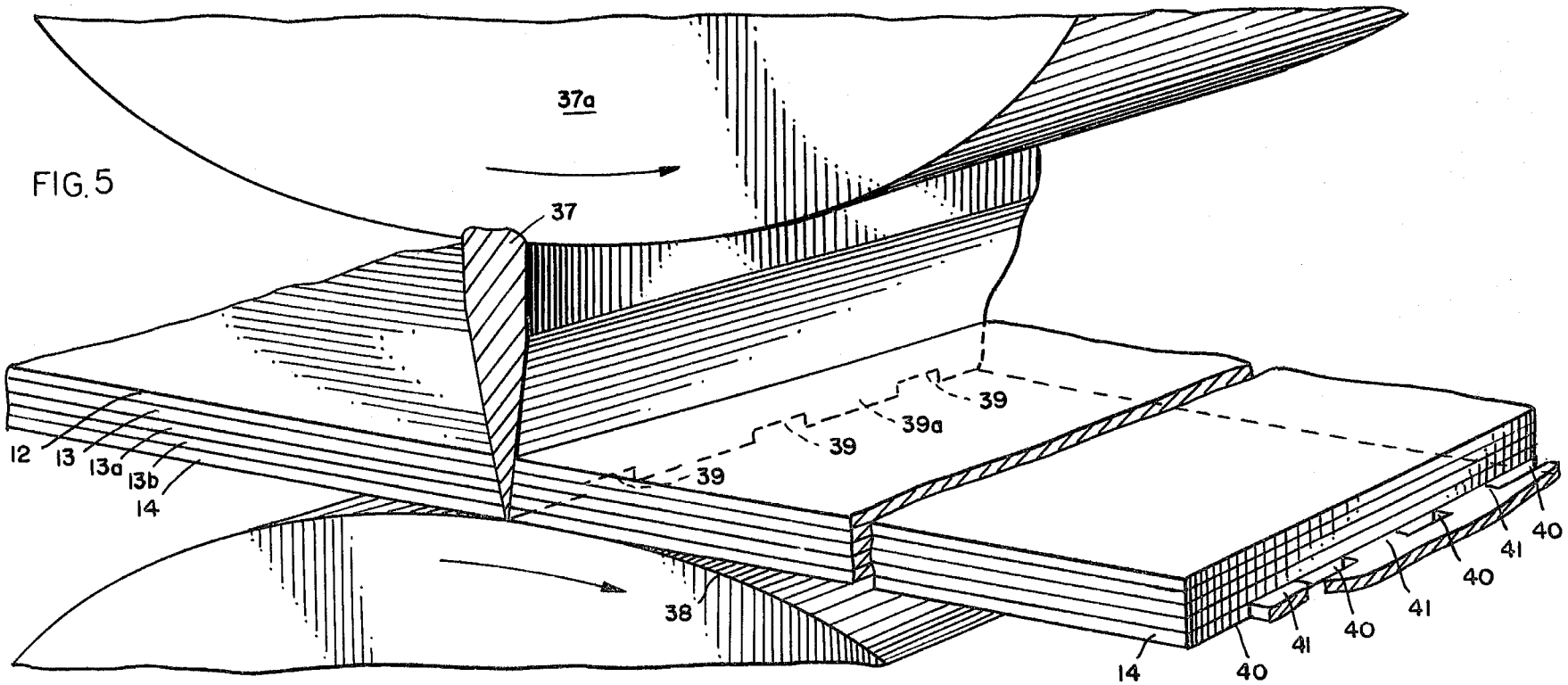
FIG. 5 is an enlarged fragmentary perspective view, partially in section of cutting apparatus employable in the practice of the invention.

In one preferred way of practicing the invention, the webs 12–14 are imperforate and uncut until encountering the station 36. In the station 36, they encounter a rotary knife blade 37 which acts against a hardened impression cylinder or anvil roll 38. As seen in FIG. 5, the blade 37 is operating against interior webs 12, 13, 13*a* and 13*b* as well as the bottom web 14. The knife or blade 37 is recessed or notched at spaced areas across the face of the webs as at 39 which results in the development of transverse slits 40 separated by bonds 41 in the web 14. However, all of the other webs are transversely slit to provide the cuts 21 previously referred to. Thus, I provide an advantageous cutting and perforating function simultaneously within the station 36. However, it will be appreciated that in some instances it may be advantageous to provide the perforating function elsewhere. For example, the invention contemplates the provision of the transverse lines of weakness or perforation 22 in the various intermediate plies as part of the printing operation on paper which ultimately becomes the various parent rolls 16–18. Therefore, in like fashion, the parent roll 15 can be transversely perforated, i.e., equipped with lines of weakness.

Thus, the notches 39 develop positioning feet 39a which bear against the surface of the hardened impression cylinder 38 to establish and maintain the blade in proper position to selectively cut the upper plies and perforate the lowermost ply. It will be appreciated that should the perforating of the web 14 be advantageously performed at another point in the processing, the knife 37 can be suitably arranged relative to the surface of the hardened impression cylinder 38 so as only to cut the intermediate plies and not affect the bottom ply 14. Suitable spacing can be provided for this purpose between the cylinder 38 and the cylinder 37a which carries the blade 37, such spacer ordinarily being known to the art by the term "bearers".

After the interior plies are cut, the second single web 11 (the first single web being the web 14) is united with the cut interior plies and is so arranged that the line of weakness 24 is aligned with the line of weakness 30 in the bottom ply 14—and also aligned with the cuts 21 in the various intermediate plies (see the extreme left hand portion of FIG. 4). Thereafter, the now integrated plies are sent through a folding unit 42 to develop the well-known zig-zag stack of business forms 43.

As illustrated, the intermediate plies are equal in length to the exterior plies—by virtue of the lines of weakness 24 and 30 being aligned with the longitudinally spaced lines of cutting 21.

Figure 3:
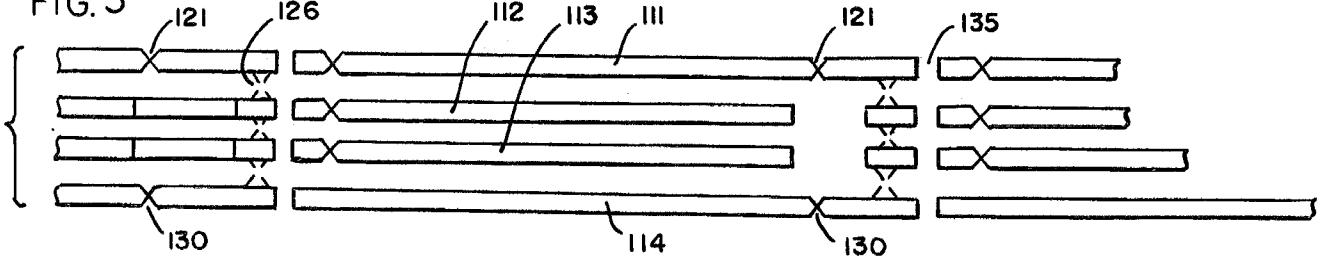
FIG. 3 is a view similar to FIG. 2 but of a modified version of the business form made according to the teachings of the invention.

In some instances, however, it may be advantageous to have the interior plies shorter than the exterior plies, i.e., spacing the lines of weakness 121 and 130 in the plies 111 and 114, respectively a distance apart greater than the length of the intermediate plies 112 and 113 (see FIG. 3). This may be achieved advantageously through advancing the webs 112 and 113 which ultimately become the intermediate plies at a rate slower than the advancement of the web 114 which becomes the bottom ply—but then performing the steps of cutting and perforating at the same frequency. Alternatively, it is possible to advance the webs 112 and 113 at the same rate as the web 114 and also perform the steps of cutting and perforating at the same frequency but achieve the configuration of FIG. 3 by removing a portion of "chip" from each of the intermediate webs 112 and 113. Other than effectively foreshortening interior plies 112 and 113 in the version seen in FIG. 3, the business form is essentially the same as that described in conjunction with FIGS. 1 and 2. For example, the uppermost or top exterior ply 111 is adhered to the topmost intermediate ply 112 by adhesive as at 126. Likewise, each of the webs or plies have register openings as at 135.

While in the foregoing specification, a detailed description of the invention has been set down for the purpose of illustration, many variations in the details hereingiven may be made by those skilled in the art without departing from the spirit and scope of the invention.

I claim:

1. A method for producing a form suitable for airline ticketing comprising:

advancing a plurality of superposed webs toward a uniting station, said webs being equipped with register means and being printed so as to constitute the interior plies of said form, advancing a first single web toward said station for union with said plurality of webs, said first single web being equipped with register means and printed so as to constitute one exterior ply of said form, equipping said first single web with longitudinally spaced lines of transverse weakness, cutting said plurality of webs along longitudinally spaced lines to provide a series of severed groups of interior ticket plies and, after said cutting, uniting a second single web with said plurality, said second single web being equipped with register openings and printed so as to constitute the other exterior ply of said form, said other exterior ply also being equipped with longitudinally spaced lines of transverse weakness aligned with the longitudinally spaced lines of transverse weakness in said first single web, each said group being positioned between two pairs of adjacent spaced lines of transverse weakness, each said group and the associated two exterior plies being adhesively united.

2. The method of claim 1 in which said longitudinally spaced lines of weakness are aligned with said longitudinally spaced lines of cutting whereby said interior plies have the same length as said exterior plies.

3. A method of producing a form suitable for airline ticketing comprising:

advancing a plurality of superposed webs toward a uniting station, said webs being equipped with register means and being printed so as to constitute the interior plies of said form, advancing a first single web toward said station for union with said plurality of webs, said first single web being equipped with register means and printed so as to constitute one exterior ply of said form, equipping said first single web with longitudinally spaced lines of transverse weakness, cutting said plurality of webs along longitudinally spaced lines and, after said cutting, uniting a second single web with said plurality, said second single web being equipped with register openings and printed so as to constitute the other exterior ply of said form, said other exterior ply also being equipped with longitudinally spaced lines of transverse weakness aligned with the longitudinally spaced lines of transverse weakness in said first single web, said longitudinally spaced lines of weakness being aligned with said longitudinally spaced lines of cutting whereby said interior plies have the same length as said exterior plies, said cutting of said plurality of webs being performed simultaneously with the equipping of said first single web with said longitudinally spaced lines of transverse weakness.

4. The method of claim 3 in which said equipping of said second single web with said longitudinally spaced lines of transverse weakness is performed prior to uniting said second single web with said plurality.

5. A method of producing a form suitable for airline ticketing comprising:

advancing a plurality of superposed webs toward a uniting station, said webs being equipped with register means and being printed so as to constitute the interior plies of said form, advancing a first single web toward said station for union with said plurality of webs, said first single web being equipped with register means and printed so as to constitute one exterior ply of said form, equipping said first single web with longitudinally spaced lines of transverse weakness, cutting said plurality of webs along longitudinally spaced lines and, after cutting, uniting a second single web with said plurality, said second single web being equipped with register openings and printed so as to constitute the other exterior ply of said form, said other exterior ply also being equipped with longitudinally spaced lines of transverse weakness aligned with the longitudinally spaced lines of transverse weakness in said first single web, said longitudinally spaced lines of weakness being spaced apart a distance greater than the length of said interior plies.

6. The method of claim 5 in which said plurality of webs are advanced at a rate slower than the advancement of said first single web, the steps of cutting and equipping said first single web with lines of weakness being performed at the same frequency.

7. A method of claim 5 in which said plurality of webs are advanced at the same rate as the advancement of said first single web, the steps of cutting including the removal of a portion of each of said plurality of webs, the steps of cutting and equipping said first single web with lines of weakness being performed at the same frequency.

8. The method of claim 1 in which at least one of said exterior plies is equipped with feeding margins along the longitudinal edges thereof.

9. The method of claim 8 in which said form is an airline ticket having a carbon-backed top ply, said top ply being equipped with said feeding margins.

10. A method of producing a form suitable for airline ticketing comprising:

advancing a plurality of superposed webs toward a uniting station, said webs being equipped with register means and being printed so as to constitute the interior plies of said form, advancing a first single web toward said station for union with said plurality of webs, said first single web being equipped with register means and printed so as to constitute one exterior ply of said form, superposing said plurality of webs on said first single web and thereafter cutting said plurality of webs on said first single web along longitudinally spaced lines, equipping said first single web with longitudinally spaced lines of transverse weakness, and after said cutting, uniting a second single web with said plurality, said second single web being equipped with register means and printed so as to constitute the other exterior ply of said form, said other exterior ply also being equipped with longitudinally spaced lines of transverse weakness aligned with the longitudinally spaced lines of transverse weakness in said first single web.

11. The method of claim 10 in which the longitudinally spaced lines of weakness in said first single web are introduced simultaneously with the cutting of said plurality of webs.

12. The method of claim 11 in which said simultaneous cutting and weakening are performed by a knife equipped with spaced cutting feet bearing against a hardened impression cylinder.

* * * * *